US010590692B2

(12) United States Patent
Bohle

(10) Patent No.: US 10,590,692 B2
(45) Date of Patent: Mar. 17, 2020

(54) FURNITURE DRIVE SYSTEM

(71) Applicant: Julius Blum GmbH, Hoechst (AT)

(72) Inventor: Wolfgang Bohle, Goetzis (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/133,166

(22) Filed: Sep. 17, 2018

(65) Prior Publication Data

US 2019/0010747 A1 Jan. 10, 2019

Related U.S. Application Data

(63) Continuation of application No. PCT/AT2017/060027, filed on Feb. 14, 2017.

(30) Foreign Application Priority Data

Apr. 15, 2016 (AT) ..... A 50337/2016

(51) Int. Cl.
*E05F 15/63* (2015.01)
*E05F 1/10* (2006.01)
*E05D 15/40* (2006.01)

(52) U.S. Cl.
CPC ..... *E05F 15/63* (2015.01); *E05D 15/401* (2013.01); *E05F 1/1058* (2013.01); (Continued)

(58) Field of Classification Search
CPC ..... E05F 1/1058; E05F 15/63; E05D 15/401
(Continued)

(56) References Cited

U.S. PATENT DOCUMENTS 8,011,741 B2 9/2011 Mattle
8,056,992 B2 11/2011 Gassner
(Continued)

FOREIGN PATENT DOCUMENTS

CN 101668457 3/2010
CN 102421980 4/2012
(Continued)

OTHER PUBLICATIONS

English translation of Search Report dated Aug. 23, 2019 in Chinese Application No. 201780022932.8.
(Continued)

*Primary Examiner* — James O Hansen
(74) *Attorney, Agent, or Firm* — Wenderoth, Lind & Ponack, L.L.P.

(57) ABSTRACT

A furniture drive system includes a mechanical control unit having a pivotably mounted control arm for moving a movable furniture part, a spring device for applying force to the control arm, and a movably mounted control part having a transmission opening for transmitting a force from the spring device to the control arm. An electrical drive unit has an electric motor for moving the movable furniture part, and a driver to be driven by the electric motor for transmitting a torque of the electric motor to the mechanical control unit. The driver can be inserted into the transmission opening, and the electrical drive unit and the mechanical control unit are designed as separate assemblies and can be fastened to each other. A contact surface for the driver is arranged laterally adjacent to the transmission opening and the driver is preloaded toward the contact surface by a force store.

14 Claims, 7 Drawing Sheets

(52) U.S. Cl.
CPC ..... *E05Y 2201/616* (2013.01); *E05Y 2201/71* (2013.01); *E05Y 2600/11* (2013.01); *E05Y 2800/11* (2013.01); *E05Y 2800/205* (2013.01); *E05Y 2800/232* (2013.01); *E05Y 2800/238* (2013.01); *E05Y 2900/20* (2013.01)

(58) Field of Classification Search
USPC ..... 312/326, 327, 319.5, 319.6, 319.2
See application file for complete search history.

(56) References Cited

U.S. PATENT DOCUMENTS

| | | | |
|---|---|---|---|
| 8,303,054 | B2 | 11/2012 | Mattle |
| 8,303,055 | B2 | 11/2012 | Scheffrknecht et al. |
| 8,317,276 | B2 | 11/2012 | Huber et al. |
| 8,590,990 | B2 | 11/2013 | Friesenecker |
| 9,624,709 | B2 | 4/2017 | Friesenecker et al. |
| 2010/0026153 | A1 | 2/2010 | Mattle |
| 2010/0041484 | A1 | 2/2010 | Gassner |
| 2010/0043595 | A1 | 2/2010 | Mattle |
| 2010/0327717 | A1 | 12/2010 | Huber et al. |
| 2011/0138960 | A1* | 6/2011 | Omann ..... E05C 19/165 74/490.07 |
| 2011/0193458 | A1* | 8/2011 | Omann ..... E05D 15/401 312/319.2 |
| 2012/0032570 | A1 | 2/2012 | Friesenecker et al. |
| 2012/0049709 | A1 | 3/2012 | Scheffrknecht et al. |
| 2012/0056521 | A1 | 3/2012 | Friesenecker |
| 2015/0240546 | A1* | 8/2015 | Oshima ..... E05F 1/14 16/80 |

FOREIGN PATENT DOCUMENTS

| | | |
|---|---|---|
| WO | 2008/134785 | 11/2008 |
| WO | 2008/134786 | 11/2008 |
| WO | 2009/114883 | 9/2009 |
| WO | 2010/129979 | 11/2010 |
| WO | 2010/129980 | 11/2010 |
| WO | 2010/129981 | 11/2010 |

OTHER PUBLICATIONS

International Search Report dated May 16, 2017 in International (PCT) Application No. PCT/AT2017/060027.

* cited by examiner

FURNITURE DRIVE SYSTEM

BACKGROUND OF THE INVENTION

The present invention relates to a furniture drive system for a furniture part movably-supported on a furniture carcass, including a mechanical actuating unit with: at least one pivotally mounted actuating arm for moving the movable furniture part, a spring device for applying a force to the actuating arm, and a movably-mounted actuating portion having a transmission opening for transmitting a force from the spring device to the actuating arm. The furniture drive system further includes an electrical drive unit with: an electric motor for the electromotive support of a movement of the movable furniture part, and an entrainment member configured to be driven by the electric motor for transmitting a torque from the electric motor to the mechanical actuating unit. The entrainment member of the electrical drive unit can be engaged into the transmission opening of the actuating portion, and the electrical drive unit and the mechanical actuating unit are configured as separate constructional units which can be fixed to one another.

The invention further relates to a method for mounting an electrical drive unit to a mechanical actuating unit.

The invention further relates to an item of furniture with a furniture part movably-supported on a furniture carcass and with a furniture drive system of the type to be described.

Such furniture drive systems are commonly known according to WO 2008/134786 A1 and WO 2010/129979 A1. The mechanical actuating unit thereby includes an actuating arm pressurized by a spring device for moving a furniture flap. For additionally supporting a movement of the actuating arm, an electrical drive unit can optionally be connected to the housing of the mechanical actuating unit. The mechanical actuating unit and the electrical drive unit are configured as constructional units being separate from each other, so that the electrical drive unit, if required, can be provided as an additional drive module which is easy to be replaced. The electrical drive unit includes a force transmission device with an entrainment pin for transmitting a force provided by the electrical drive unit to the mechanical actuating unit and thereby supports an opening and/or closing movement of the actuating arm. The entrainment pin of the electrical drive unit, in the mounting position, engages into a corresponding transmission opening of the mechanical actuating unit. For a proper cooperation between the mechanical actuating unit and the electrical drive unit, the entrainment pin and the transmission opening must be exactly pre-positioned relative to one another. After pre-positioning has been effected, mounting of the electrical drive unit is possible. However, the correct pre-positioning may in fact cause difficulties, because the housing of the electrical drive unit, when being mounted, covers both the entrainment pin and the transmission opening and, as a result, impedes the visibility for the assembling person. Moreover, incorrect installations may arise, because the entrainment pin can inadvertently be moved past the transmission opening and is finally not in engagement with the transmission opening. By such an incorrect installation, the functionality of the furniture drive system is naturally not ensured.

SUMMARY OF THE INVENTION

It is an object of the present invention to propose a furniture drive system of the type mentioned in the introductory part, in which a reliable force transmission between the electric drive device and the mechanical actuating unit can be established.

According to the invention, it is provided that an abutment surface for the entrainment member is arranged laterally besides the transmission opening, and that the entrainment member is pre-stressed by an energy storage member in a direction towards the abutment surface, wherein the entrainment member in a position, in which the entrainment member is aligned flush with the transmission opening, automatically penetrates into the transmission opening by the force of the energy storage member.

In a first mounting step, the mechanical actuating unit is thus mounted to a furniture carcass. In a further mounting step, the electrical drive unit is fixed to the mechanical actuating unit. In a further step, the actuating arm and/or the electric motor is being moved, whereby the entrainment member pre-stressed by the energy storage member can be displaceably guided along the abutment surface, until a longitudinal direction of the entrainment member flushes with a longitudinal axis of the transmission opening. As soon as the entrainment member and the transmission opening are finally aligned flush to one another, the entrainment member is being pressed into the transmission opening by the force of the discharging energy storage member, wherein the movement coupling between the electric drive and the mechanical actuating unit is established.

The method according to the invention for mounting an electrical drive unit to a mechanical actuating unit for moving a movably-supported furniture part is characterized by the following steps: mounting the mechanical actuating unit to a furniture carcass, fixing the electrical drive unit to the mechanical actuating unit, and moving the pivotally mounted actuating arm of the mechanical actuating unit and/or moving the electric motor of the electric drive device. The entrainment member is pre-stressed in a direction towards an abutment surface of the mechanical actuating unit and can be guided along the abutment surface by a movement of the actuating arm and/or by a movement of the electric motor. The actuating arm and/or the electric motor are moved as long as the entrainment member of the electrical drive unit automatically penetrates into the transmission opening of the mechanical actuating unit by the force of the energy storage member.

BRIEF DESCRIPTION OF THE DRAWINGS

Further details and advantages of the present invention result from the embodiment shown in the drawings, in which.

DETAILED DESCRIPTION OF THE INVENTION

Figure 1A:
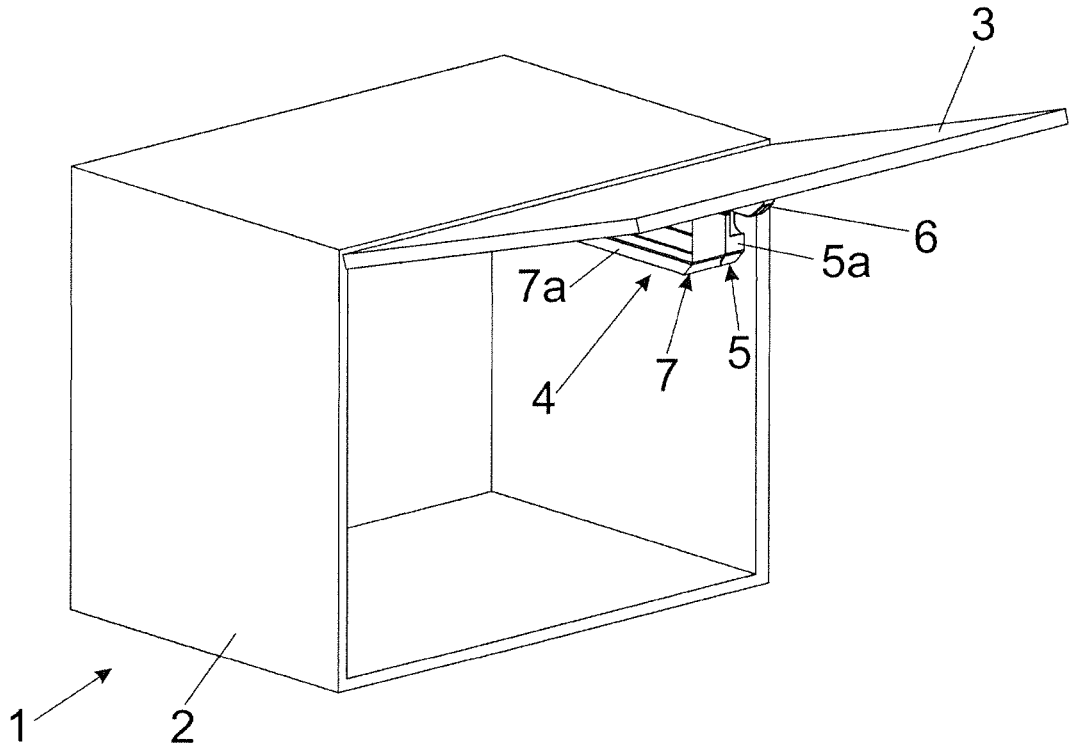
FIGS. 1*a*, 1*b* are a perspective views of an item of furniture with a movable furniture part which is movably supported relative to a furniture carcass by a furniture drive system, and a view of the furniture drive system mounted to the furniture carcass.

FIG. 1*a* shows an item of furniture 1 with a furniture carcass 2, in which a movable furniture part 3 in the form of a furniture flap can be movably supported relative to the furniture carcass 2 by a furniture drive system 4. The furniture drive system 4 includes a mechanical actuating unit 5 having a housing 5*a* and an actuating arm 6, the actuating arm 6 being pivotally mounted relative to the housing 5*a* and being provided for moving the furniture part 3. The furniture drive system 4 further includes an electrical drive unit 7 having a housing 7*a,* and the electrical drive unit 7 is provided for the electromotive support of the movable furniture part 3. The mechanical actuating unit 5 and the electrical drive unit 7 are configured as separate constructional units, and the housing 5*a* of the mechanical actuating unit 5 and the housing 7*a* of the electrical drive unit 7 are configured so as to be fixed to one another, preferably by a locking device and/or by a screw connection. The two housings 5*a* and 7*a,* for mutually resting against each other, each have flat-shaped wall portions in order to enable a relative compact construction of the furniture drive system 4.

Figure 1B:
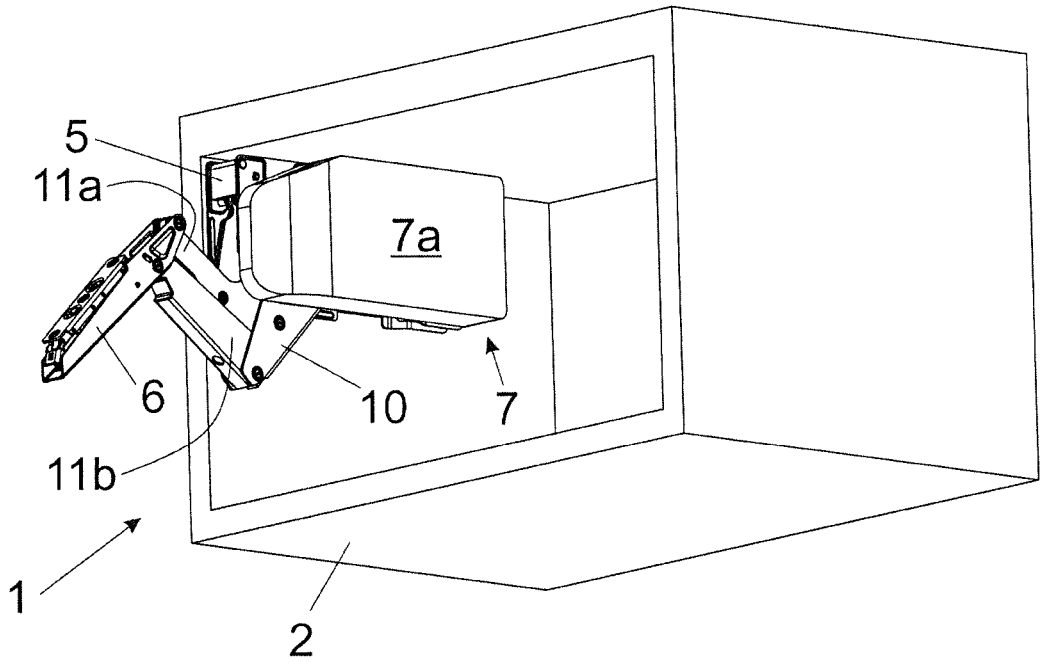

FIG. 1*b* shows the item of furniture 1 with the furniture part 3 hidden. In a first mounting step, the mechanical actuating unit 5 is mounted to the furniture carcass 2. The mechanical actuating unit 5 includes a pivotally mounted actuating arm 6 configured to be acted upon by a spring device 18 (FIG. 3). The mechanical actuating unit 5 further includes a movably-mounted actuating portion 10 by which a force from the spring device 18 can be transmitted to the actuating arm 6. Moreover, two levers 11*a* and 11*b* are provided for moving the actuating arm 6. The housing 7*a* of the electrical drive unit 7 can be fixed to the housing 5*a* of the mechanical actuating unit 5, and a movement of the actuating arm 6 is supported by an electric motor 12 (FIG. 2) of the electrical drive unit 7.

Figure 2:
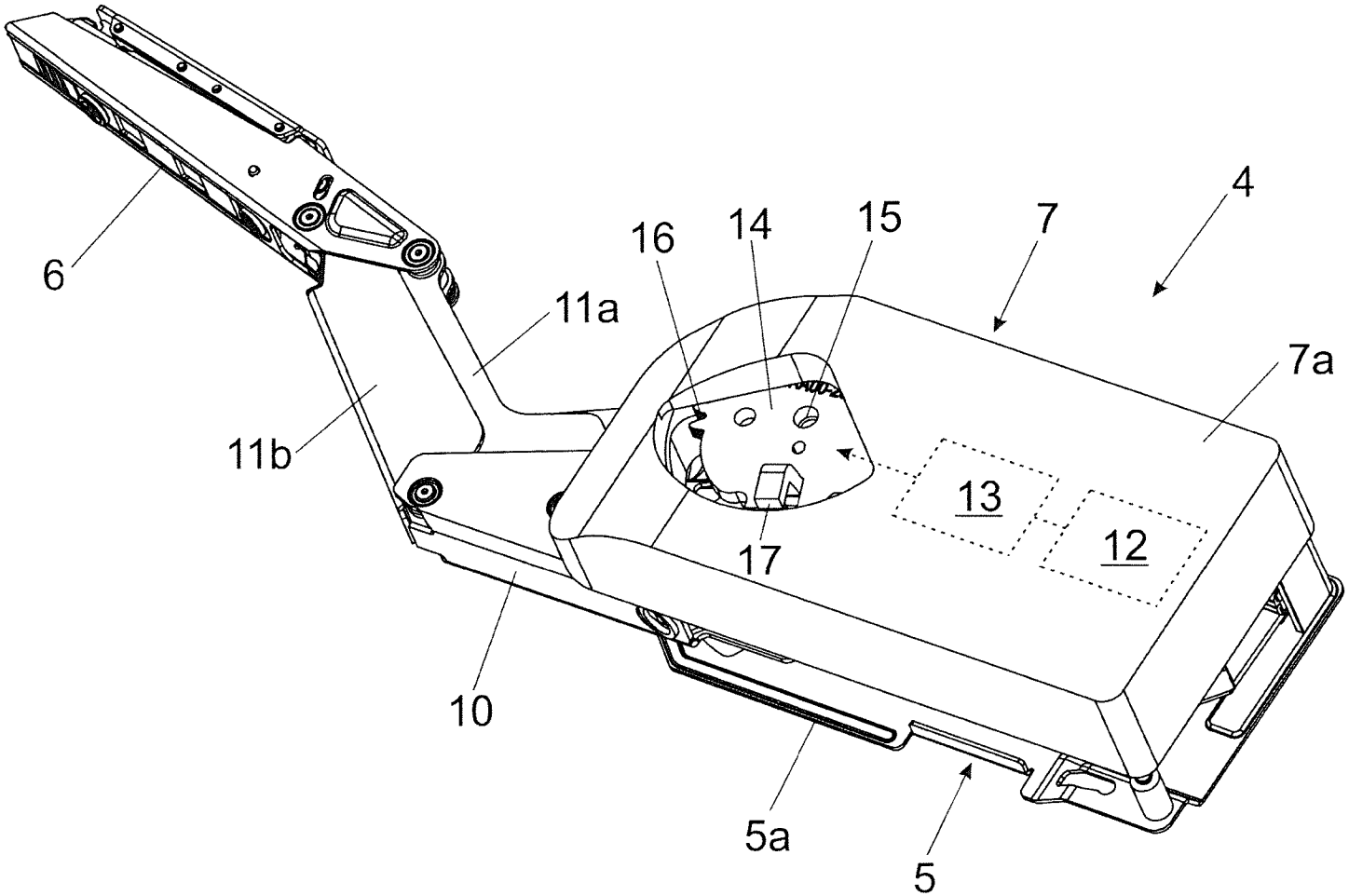
FIG. 2 shows the furniture drive system in a perspective view.

FIG. 2 shows the furniture drive system 4 in a perspective view, in which the housing 5*a* of the mechanical actuating unit 5 and the housing 7*a* of the electrical drive unit 7 are fixed to one another. The mechanical actuating unit 5 includes a pivotally mounted actuating portion 10 and the two levers 11*a,* 11*b* for moving the actuating arm 6. On the other hand, the electrical drive unit 7 includes a schematically depicted electric motor 12 and a control or regulating device 13 for controlling or regulating the electrical drive unit 7. A movably-mounted transmission element 14 of the electrical drive unit 7 can be driven by the electric motor 12. In the shown embodiment, the transmission element 14 is configured as a gear pivotally mounted about a pivoting axis 15, and the gear has a tooth arrangement 16, preferably an eccentric tooth arrangement. By the tooth arrangement 16 configured as an eccentric tooth arrangement, a very high torque is available when the movable furniture part 3 is located in the end positions (i.e. when the electric motor 12 starts slowly). Visible is a supporting element 17 arranged on the transmission element 14, the supporting element 17 is provided for supporting an energy storage member 23 (FIG. 3) which is provided for pre-stressing an entrainment member 22 for transmitting a force to the mechanical actuating unit 5.

Figure 3A:
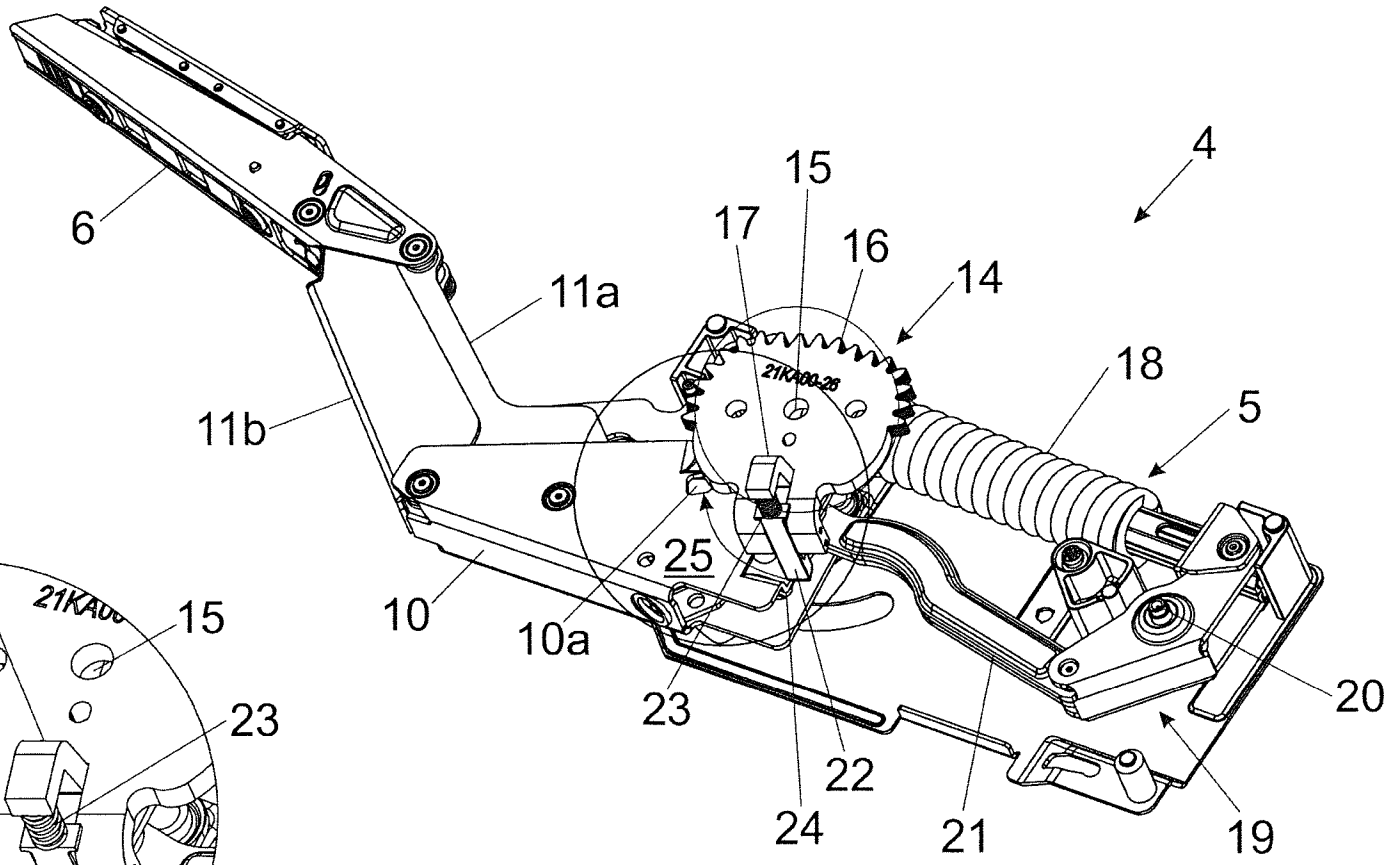
FIG. 3*a*, 3*b* are perspective views of the furniture drive system in which only the transmission element and the entrainment member pre-stressed by the energy storage member are shown as parts of the electrical drive unit, and an enlarged detail view thereof.
Figure 3B:
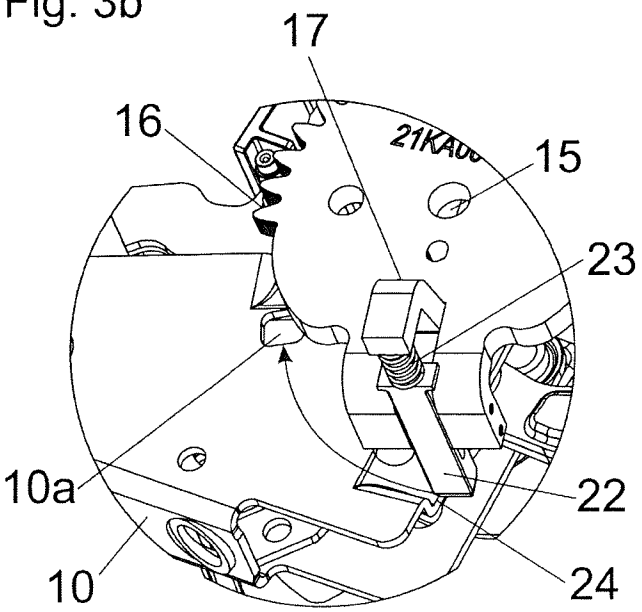

FIG. 3*a* shows the furniture drive system 4 in a perspective view, in which only the pivotally mounted transmission element 14 and the entrainment member 22 pressurized by the energy storage member 23 are depicted as parts of the electrical drive unit 7. The mechanical actuating unit 5 includes at least one actuating arm 6 to be fixed to the movable furniture part 3, the actuating arm 6 can be acted upon by a spring device 18, preferably by at least one compression spring. The force from the spring device 18 can be transmitted by a transmission mechanism to the actuating arm 6, and the transmission mechanism, in the shown figure, includes a two-armed lever 19 pivotally mounted about a pivoting axis 20, a pushing element 21, the actuating portion 10 and the two levers 11*a*, 11*b*. The transmission element 14 of the electrical drive unit 7 is pivotally mounted about a pivoting axis 15 and includes a tooth arrangement 16 cooperating with a (not shown) multistage reduction gear of the electrical drive unit 7, so that the high revolution speed of the electric motor 12 is reduced and a high level of torque can be transmitted to the transmission element 14. The transmission element 14 is thereby arranged on the last stage of the multistage reduction gear and is freely movable within predetermined limits in both pivoting directions by a (not shown) freewheel coupling. The entrainment member 22 of the electrical drive unit 7 which is provided for the transmission of torque to the actuating portion 10 of the mechanical actuating unit 5 is arranged on the transmission element 14 and is displaceably mounted in a limited manner on the transmission element 14 in a direction extending parallel to the pivoting axis 15. By an energy storage member 23, preferably in the form of a compression spring, cooperating on the one hand with the supporting element 17 of the transmission element 14 and on the other hand with the entrainment member 22, the entrainment member 22 is pre-stressed in a direction perpendicular to the abutment surface 25. The abutment surface 25, in the shown embodiment, is formed by the actuating portion 10 and is located laterally besides a transmission opening 10*a* of the actuating portion 10, and the entrainment member 22, for establishing the torque transmission, can be engaged into the transmission opening 10*a* of the actuating portion 10. After the electrical drive unit 7 has been mounted to the mechanical actuating unit 5, the actuating arm 6 is manually moved and/or the electric motor 12 is being started, whereby the entrainment member 22 is moved in a clockwise direction of the depicted arrow until the entrainment member 22 and the transmission opening 10*a* of the actuating portion 10 are aligned flush with one another, and the entrainment member 22 automatically snaps into the transmission opening 10*a* of the actuating portion 10 by the force of the discharging energy storage member 23. In order to prevent the entrainment member 22 from abutting against the material thickness of the actuating portion 10 upon the pivotal movement in the direction of the arrow, the actuating portion 10 is provided with a ramp 24 by which the entrainment member 22, starting from a position being lower with respect to the abutment surface 25, can be lifted against the force of the energy storage member 23 in a direction towards the abutment surface 25. FIG. 3*b* shows an enlarged view of the region encircled in FIG. 3*a*.

Figure 4A:
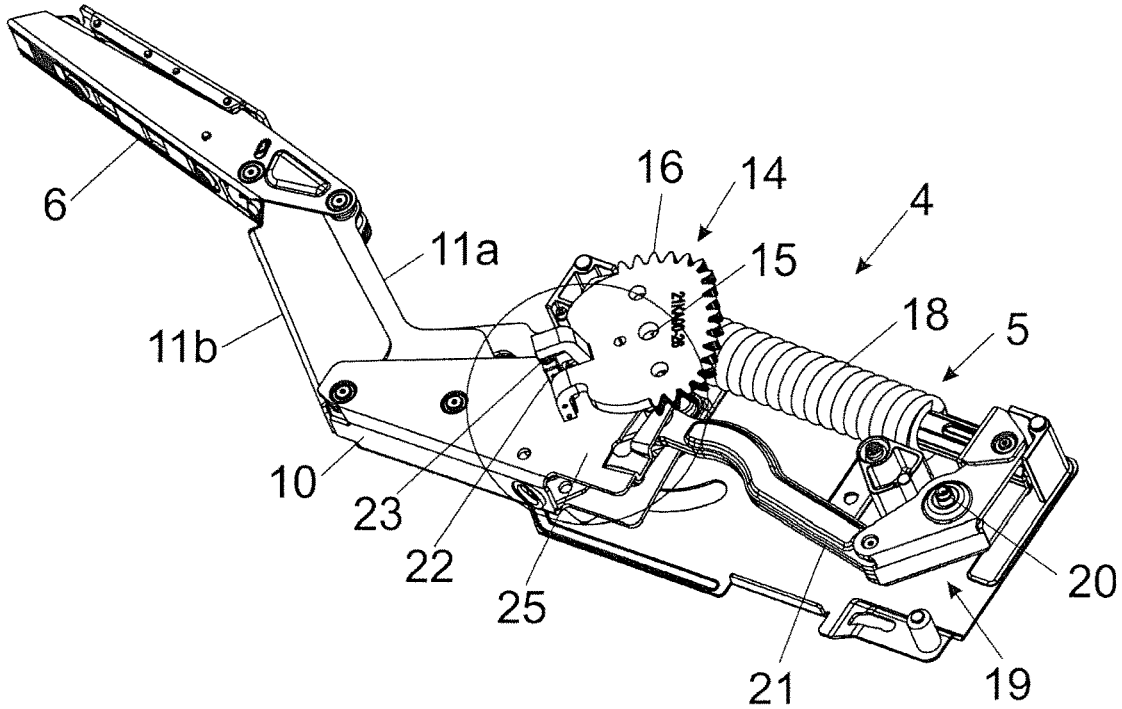
FIG. 4*a*, 4*b*, 4*c* are perspective views of the furniture drive system with detail views of the entrainment member in an unlocked position and in a locked position.
Figure 4B:
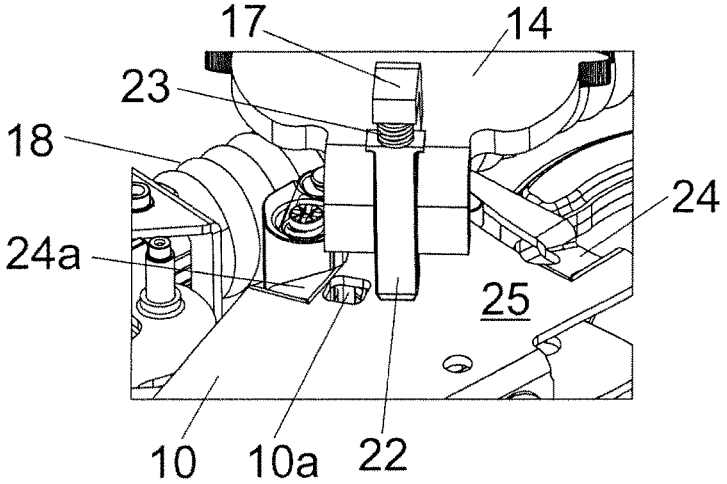
Figure 4C:
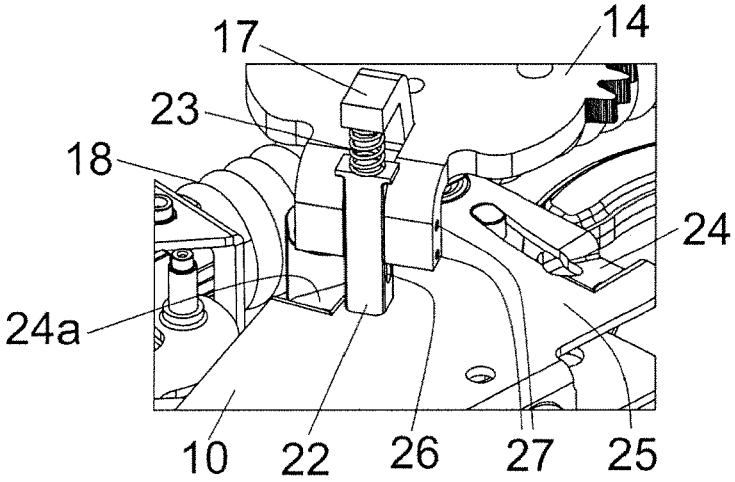

FIG. 4*a* shows a perspective view of the furniture drive system 4, in which the entrainment member 22 has been moved closer in a direction towards the transmission opening 10*a* of the mechanical actuating unit 5 by a movement of the actuating arm 6 and/or by a movement of the electric motor 12. FIG. 4*b* shows an enlarged detail view of the entrainment member 22 being movably-mounted on the transmission element 14, and the entrainment member 22 rests against the abutment surface 25 by the force of the energy storage member 23. The entrainment member 22 can be lifted by the ramp 24 to the height of the abutment surface 25, and the energy storage member 23 is in a tensioned condition. The actuating arm 6 and/or the electric motor 12 is moved or are moved as long as the entrainment member 22 and the transmission opening 10*a* are aligned in a flush position relative to one another, until finally the entrainment member 22—as shown in FIG. 4*c*—snaps into the transmission opening 10*a* without clearance by the force of the discharging energy storage member 23, so that the transmission of torque between the electrical drive unit 7 and the mechanical actuating unit 5 can be established. The entrainment member 22, as shown in FIG. 4*c*, is linearly displaceable between two protrusions of the transmission element 14 by a guide 26 into which guide pins 27 engage, so that the entrainment member 22 is displaceably mounted in a limited manner in a direction extending perpendicular to the abutment surface 25. By a further ramp 24*a* of the actuating portion 10, the entrainment member 22 can also be lifted towards the abutment surface 25 when the transmission element 14 performs a movement in the opposite pivoting direction. However, the arrangement of the ramps 24, 24*a* can also be omitted, provided that the entrainment member 22 can be supported over the entire movement path on a plane coplanar to the abutment surface 25.

Figure 5A:
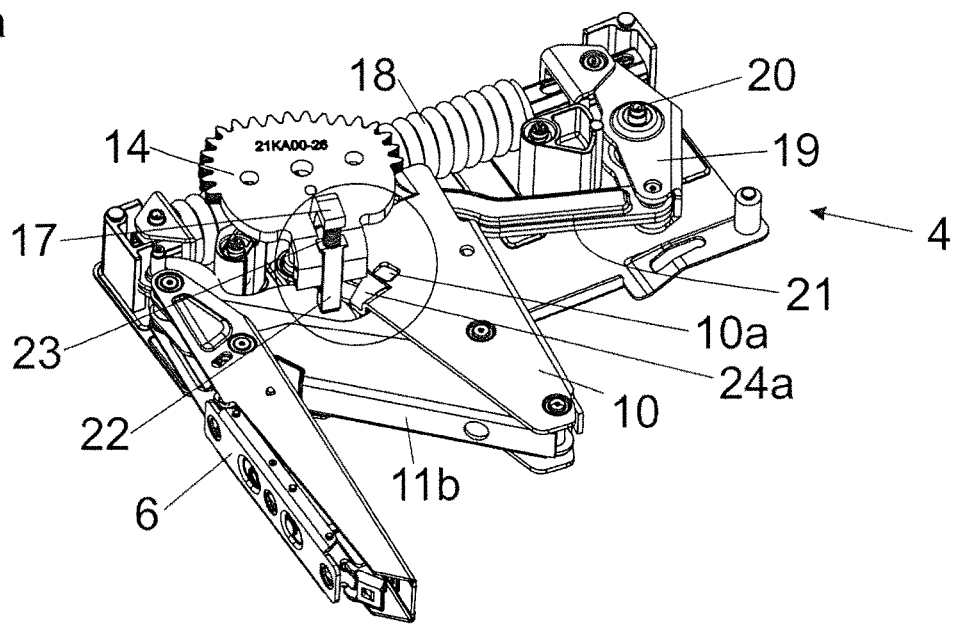
FIG. 5*a*, 5*b*, 5*c*, 5*d* are perspective views of the furniture drive system with the actuating arm in a closed position, and enlarged detail views of the entrainment member locking into the transmission opening.
Figure 5B:
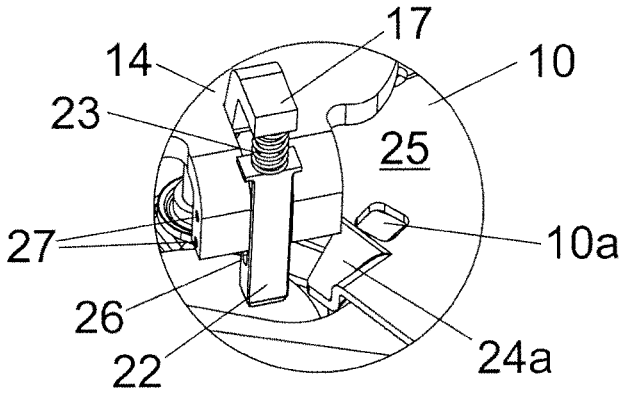
Figure 5C:
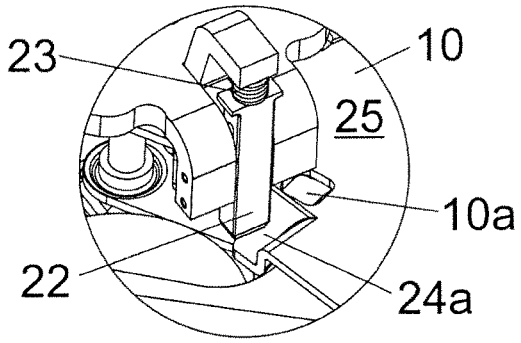
Figure 5D:
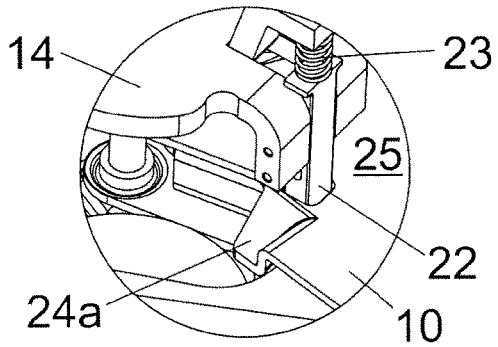

FIG. 5*a* shows the furniture drive system 4 in a perspective view, in which the actuating arm 6 is located in a closed position (delivery condition when leaving the factory). After the electrical drive unit 7 has been mounted to the mechanical actuating unit 5, the actuating arm 6 is being moved slightly in a direction towards the open position by a manual actuation and/or by starting the electric motor 12, so that the entrainment member 22 being pre-stressed by the energy storage member 23 in a direction of the abutment surface 25 moves, starting from the position shown in FIG. 5*b*, onto the further ramp 5*c*, whereby the energy storage member 23 is being loaded (FIG. 5*c*). When the entrainment member 22 and the transmission opening 10*a* of the actuating portion 10 are aligned flush with one another, the entrainment member 22 is automatically latchable in a form-locking manner into the transmission opening 10*a* of the actuating portion 10 by the force of the discharging energy storage member 23 (FIG. 5*d*).

In the shown figures, the actuating portion 10 with the transmission opening 10*a*, into which the entrainment member 22 can be engaged, is configured as a component being separate from the actuating arm 6. It is, however, also possible that the actuating portion 10, together with the actuating arm 6, has a one-piece configuration, so that the transmission opening 10*a* is arranged in or on the actuating arm 6 itself. Moreover, it is also possible to arrange the transmission opening 10*a* on a different movable component of the mechanical actuating unit 5 along the power transmission acting between the spring device 18 and the actuating arm 6. The entrainment member 22 can be configured as a shaft journal having a non-circular cross section which causes, by form-locking, a non-rotatable connection with a corresponding transmission opening 10*a* of the actuating portion 10. The cross sectional area of the entrainment member 22 can therefore be configured, at least over a region, as an oval, as a square shaft or as a multi-cornered shaft, as a multi-teeth profile or as a star profile (for example as a Torx-profile).

Figure 6A:
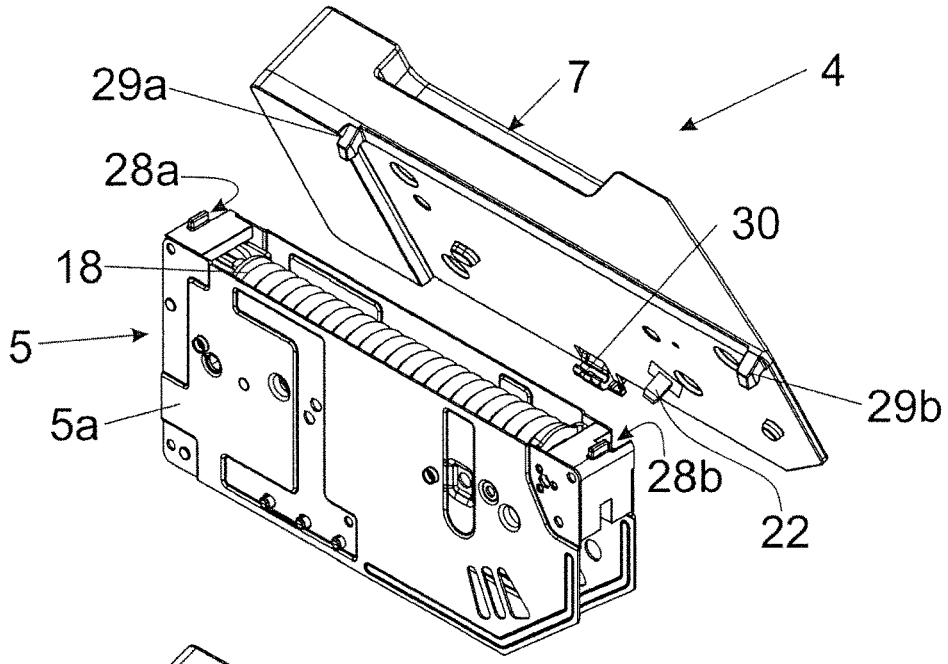
FIG. 6*a*-6*c* show a first embodiment for releasably locking the electrical drive unit to the mechanical actuating unit.
Figure 6B:
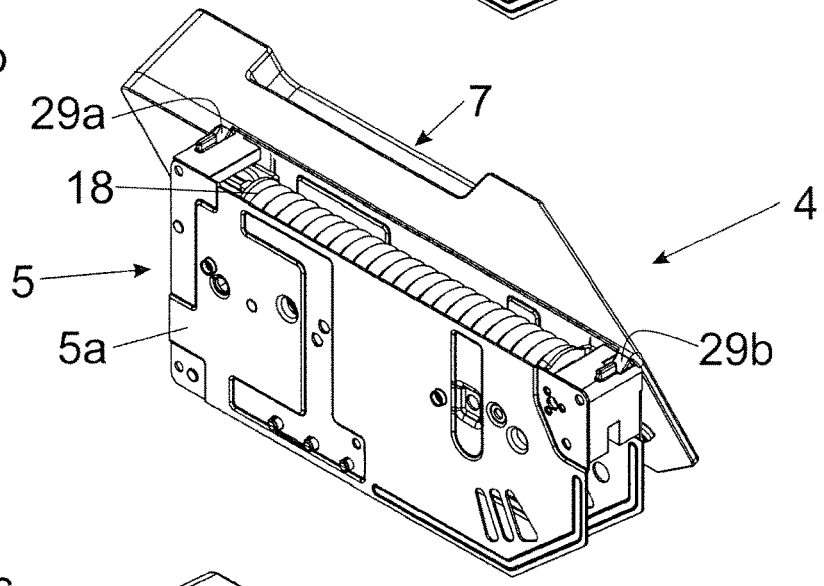
Figure 6C:
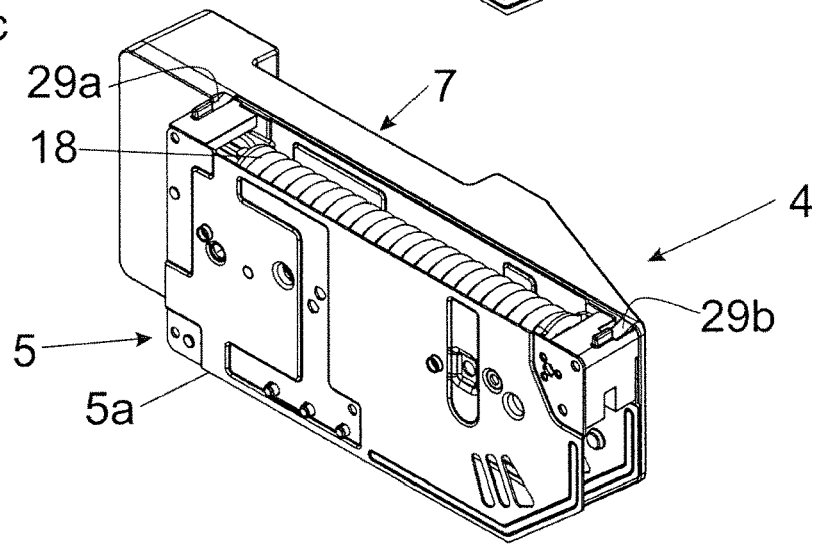

FIG. 6*a*-6*c* show a possible embodiment for releasably fixing the electrical drive unit 7 to the mechanical actuating unit 5. For the sake of improved visibility, the components protruding from the housing 5*a* of the mechanical actuating unit 5 (i.e. the actuating portion 10, the levers 11*a*, 11*b* and the actuating arm 6) are not depicted. In a first mounting step, the mechanical actuating unit 5 is pre-mounted to the furniture carcass 2. The mechanical actuating unit 5 includes at least one bearing location 28*a*, 28*b* into which the electrical drive unit 7 can be engaged by at least one fastening element 29*a*, 29*b* (FIG. 6*b*). The engaged electrical drive unit 7 can then be pivoted about an axis in a direction towards the mechanical actuating unit 5, and the axis, for example, extends horizontally in the mounting condition. After having performed a pivotal movement, the electrical drive unit 7 can be locked to the mechanical actuating unit 5 by a locking device 30 (FIG. 6*c*). The locking device 30, for example, can have a movably-mounted locking lever 30*a* (FIG. 7*a*-7*c*) being pre-stressed by a spring, and the locking lever 30*a*, in the mounted condition of the electrical drive unit 7, cooperates with a corresponding recess or latching edge of the mechanical actuating unit 5. In the shown embodiment, the locking lever 30*a* of the locking device 30 is pivotally mounted on the electrical drive unit 7 about a horizontally extending axis in the mounting condition and cooperates, in the locked position, with a horizontally extending edge of the housing 5*a* of the mechanical actuating unit 5. Starting from the mounting condition according to FIG. 6*c*, the entrainment member 22 (FIG. 6*a*) can automatically penetrate into the transmission opening 10*a* (not shown here) of the mechanical actuating unit 5 by the force of the energy storage member 23 upon a movement of the actuating arm 6 and/or upon a movement of the electric motor 12, whereby the transmission of torque between the electrical drive unit 7 and the at least one actuating arm 6 of the mechanical actuating unit 5 is established.

Figure 7A:
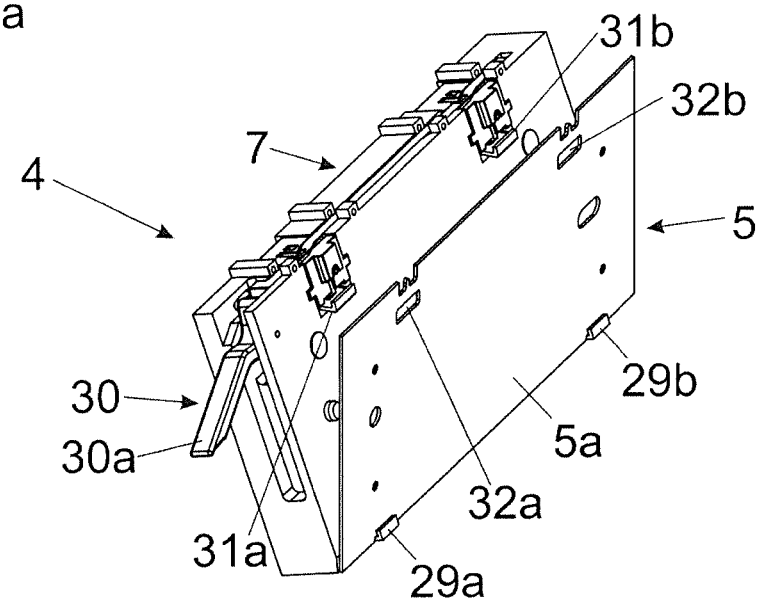
FIG. 7*a*-7*c* show a second embodiment for releasably locking the electrical drive unit to the mechanical actuating unit.
Figure 7B:
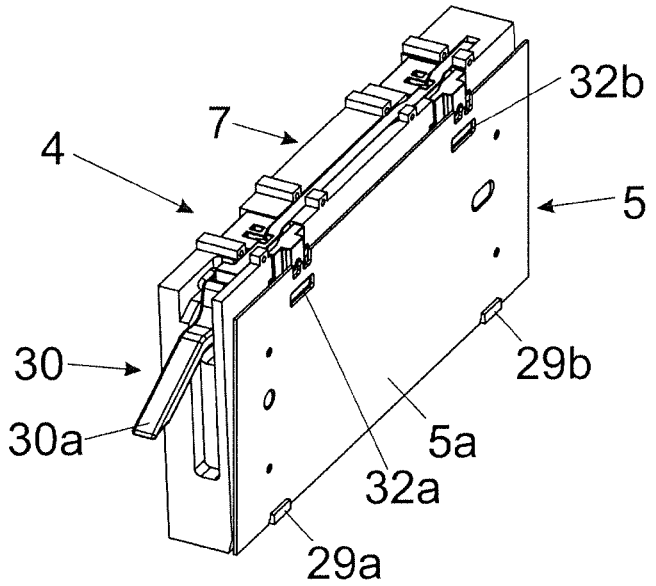
Figure 7C:
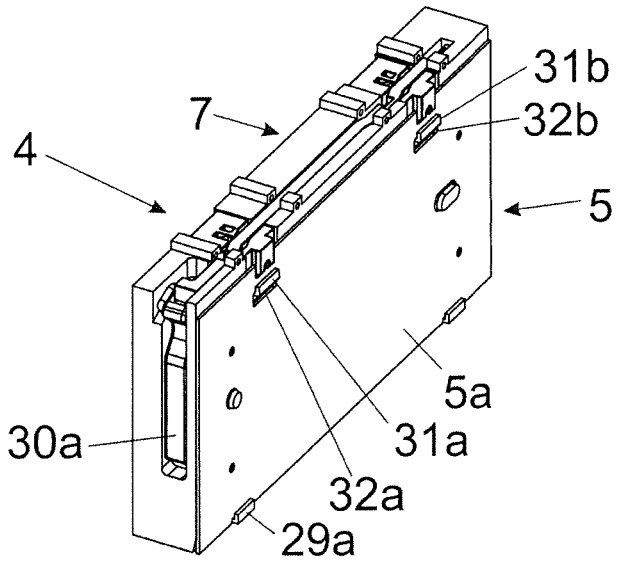

FIG. 7*a*-7*c* show a further embodiment for releasably locking the electrical drive unit 7 to the mechanical actuating unit 5 from which only the mounting plate of the housing 5*a* to be fixed to the furniture carcass 2 is visible. The electrical drive unit 7 has fastening elements 29*a*, 29*b* configured to be engaged on the housing 5*a* (FIG. 7*a*). Subsequently, the engaged electrical drive unit 7 can be pivoted about an axis, which preferably extends horizontally or vertically, in a direction towards the mechanical actuating unit 5 (FIG. 7*b*). The locking device 30 includes at least one movably-mounted locking lever 30*a* and at least one locking element 31*a*, 31*b* which can be moved, for example linearly displaced, by an actuation of the locking lever 30*a*. Arranged on the housing 5*a* of the mechanical actuating unit 5 are recesses 32*a*, 32*b* for receiving the locking elements 31*a*, 31*b*. By an actuation of the locking lever 30*a*, both locking elements 31*a*, 31*b* can be displaced upwardly in the shown figure and can thereby be locked relative to the recesses 32*a*, 32*b* of the mechanical actuating unit 5 (FIG. 7*c*). According to an embodiment, it can be provided that at least two or a plurality of locking elements 31*a*, 31*b* are connected to the locking lever 30*a* in a motionally coupled manner, so that the locking elements 31*a*, 31*b* are jointly moved with one another upon a movement of the locking lever 30*a* and thereby cause a synchronous locking and/or a synchronous unlocking of the locking elements 31*a*, 31*b* relative to the corresponding recesses 32*a*, 32*b* of the mechanical actuating unit 5. In the shown embodiment, the locking lever 30*a* is arranged on the electrical drive unit 7 and the recesses 32*a*, 32*b* are arranged on the mechanical actuating unit 5. It is, however, vice versa also possible to arrange the locking lever 30*a* on the mechanical actuating unit 5 and the recesses 32*a*, 32*b* on the electrical drive unit 7. The locking lever 30*a*, in the locking position, can be arranged flush with an outer surface of the electrical drive unit 7 or of the mechanical actuating unit 5, or—possibly—can be countersunk therein. In this way, a compact construction can be realized on the one hand. On the other hand, faulty actuations of the locking lever 30*a* and therewith an inadvertent release between the mechanical actuating unit 5 and the electric drive device 7 can be prevented.

The invention claimed is:

1. A furniture drive system for a furniture part movably-supported on a furniture carcass, said furniture drive system comprising:

a mechanical actuating unit including:

a pivotally mounted actuating arm for moving the movable furniture part, a spring device for applying a force to the actuating arm, a movably-mounted actuating portion having a transmission opening for transmitting a force from the spring device to the actuating arm, an electrical drive unit including:

an electric motor for the electromotive support of a movement of the movable furniture part, an entrainment member configured to be driven by the electric motor for transmitting a torque from the electric motor to the mechanical actuating unit, wherein the entrainment member of the electrical drive unit can be engaged into the transmission opening of the actuating portion, wherein the electrical drive unit and the mechanical actuating unit are configured as separate constructional units which can be fixed to one another, wherein an abutment surface for the entrainment member is arranged laterally besides the transmission opening, and the entrainment member is pre-stressed by an energy storage member in a direction towards the abutment surface, wherein the entrainment member in a position in which the entrainment member is aligned flush with the transmission opening automatically penetrates into the transmission opening by the force of the energy storage member.

2. The furniture drive system according to claim 1, wherein the position in which the entrainment member is aligned flush with the transmission opening, can be adjusted by a movement of the actuating arm and/or by a movement of the electric motor.

3. The furniture drive system according to claim 1, wherein the abutment surface is formed by the actuating portion.

4. The furniture drive system according to claim 1, wherein the actuating portion has at least one ramp by which the entrainment member can be lifted, starting from a lower position with respect to the abutment surface, in a direction towards the abutment surface against the force of the energy storage member.

5. The furniture drive system according to claim 1, wherein the entrainment member is arranged on a movably-mounted transmission element of the electrical drive unit, wherein the transmission element is configured to be driven by the electric motor.

6. The furniture drive system according to claim 5, wherein the movably-mounted transmission element is pivotally mounted about a pivoting axis.

7. The furniture drive system according to claim 5, wherein the movably-mounted transmission element, at least over a region, has a tooth arrangement, preferably an eccentric tooth arrangement.

8. The furniture drive system according to claim 5, wherein the entrainment member is linearly displaceably guided relative to the transmission element by at least one guide.

9. The furniture drive system according to claim 5, wherein the transmission element has a supporting element, wherein the energy storage member cooperates with the supporting element one the one hand and with the entrainment member on the other hand.

10. The furniture drive system according to claim 1, wherein the energy storage member includes at least one compression spring.

11. The furniture drive system according to claim 1, wherein the mechanical actuating unit has at least one bearing location into which the electrical drive unit can be engaged, and that the electrical drive unit being engaged into the at least one bearing location can be pivoted about an axis, which preferably extends horizontally in the mounting condition, in a direction towards the mechanical actuating unit and that a locking device is provided by which the mechanical actuating unit can be releasably locked with the electrical drive unit.

12. The furniture drive system according to claim 11, wherein the locking device includes at least one movably-mounted locking lever and at least one locking element configured to be moved by the locking lever, wherein the locking element can be locked relative to a recess arranged on the mechanical actuating unit or on the electrical drive unit upon an actuation of the locking lever.

13. The furniture drive system according to claim 12, wherein the locking device includes at least two or a plurality of locking elements which are motionally coupled to the locking lever, so that the locking elements can jointly be moved upon an actuation of the locking lever and can be synchronously locked and/or synchronously unlocked relative to corresponding recesses.

14. An item of furniture with a furniture carcass and with a furniture part movably supported on the furniture carcass, and with a furniture drive system according to claim 1 for driving the movable furniture part.

* * * * *